US006495782B1

(12) United States Patent
Huang

(10) Patent No.: US 6,495,782 B1
(45) Date of Patent: Dec. 17, 2002

(54) KEYCAP HAVING A BALANCE LEVER FOR KEYSWITCH STRUCTURE

(75) Inventor: Yao-Lun Huang, Taipei Hsien (TW)

(73) Assignee: Silitek Corporation, Taipei (TW)

( * ) Notice: Subject to any disclaimer, the term of this patent is extended or adjusted under 35 U.S.C. 154(b) by 40 days.

(21) Appl. No.: 09/653,312

(22) Filed: Sep. 1, 2000

(51) Int. Cl.[7] ..... H01H 3/12; H01H 13/70; B41J 5/16

(52) U.S. Cl. ..... 200/341; 200/345

(58) Field of Search ..... 200/5 A, 512, 200/517, 341, 342, 344, 345; 400/472, 490, 491, 491.2, 495, 495.1, 496

(56) References Cited

U.S. PATENT DOCUMENTS 4,771,146 A * 9/1988 Suzuki et al. ..... 200/344
5,376,765 A * 12/1994 Holmes et al. ..... 200/344
5,668,358 A * 9/1997 Wolf et al. ..... 200/345
5,823,325 A * 10/1998 Lin ..... 200/344
5,941,373 A * 8/1999 Cheng ..... 200/344
6,020,566 A * 2/2000 Tsai ..... 200/344
6,057,522 A * 5/2000 Chao ..... 200/341
6,100,482 A * 8/2000 Koma et al. ..... 200/344

* cited by examiner

*Primary Examiner*—J. R. Scott
(74) *Attorney, Agent, or Firm*—Rosenberg, Klein & Lee

(57) ABSTRACT

A keyswitch structure with a keycap having a balance lever is disclosed. A balance lever is pivotally installed within a keycap of a key switch. The balance lever is formed with two hooks. The balance lever is slidably matched to slots in a key seat. At least one block element (having a shape like a rib) is installed within the keycap. As the balance lever is not installed in the slots, the block element will generate a force to support and stop the balance lever so that the keycap of the key seat can not be assembled in the key seat normally and thus, it is failed in testing. Therefore, bad products can be found in the testing process. In the present invention, since a dull-proof structure is added to the balance lever of a key switch, it will prevent from unbalance due to the ineffectiveness of the balance lever as that in the prior art.

5 Claims, 6 Drawing Sheets

KEYCAP HAVING A BALANCE LEVER FOR KEYSWITCH STRUCTURE

FIELD OF THE INVENTION

The present invention relates to a keyswitch structure with a keycap having a balance lever, since a dull-proof structure is added to the balance lever of a key switch, it will prevent from unbalance due to the ineffectiveness of the balance lever as that in the prior art

BACKGROUND OF THE INVENTION

With the progress of the information technology, automatic equipment is popular in various offices and homes. Therefore, peoples have more and more time to touch keyboards. For example, keyboards of computers or cash receivers need keyboards to communicate with machines. Therefore, keyboards are frequently used in the daily life and thus, a high quality keyboard is necessary which has a beautiful outlook, a comfortable touch feeling, a beautiful sound as it is acted, a balance condition, etc.

In general, since the key switches of the long keys have keycap with a larger area than any other key, as the operator presses the keycap, the force is not exactly applied to the center of the keycap. Therefore, it is possible that the keycap will be tilted as it is pressed and cause the input data to be wrong. Moreover, the keycap will be destroyed due to improper pressing. In general, an elastic metal balance lever is added between the keycap of the key switch and the key seat. By the balance lever, the force applied to the keycap can be transferred to the center of the keycap and thus the keycap acts in a steady condition.

Referring to FIG. 1, the prior art key switch of a keyboard and the balance lever are illustrated. The key switch has a keycap 10*a*. A plurality of pivotal seats 11*a* are firmly secured within the keycap 10*a*. An elastic metal balance lever 12*a* is arranged with the pivotal seats 11*a*. Two ends of the balance lever 12*a* each are formed with hooks 13*a*. Another two respective slots 15*a* are installed on the key seat 14*a*. When the keycap 10*a* is assembled to the key seat 14*a*, the two hooks 13*a* of the balance lever 12*a* are slidably matched to the two slots 15*a* of the key seat 14*a*. When the keycap 10*a* is pressed or released so that the key switch is turned on or of, by the slots 13*a* sliding in the slots 15*a*, the keycap 10*a* moves. By the installation of the balance lever 12*a*, the force applied to the keycap 10*a* can be transferred to the center of the keycap 10*a* and thus, the keycap 10*a* acts steadily.

In general, as the keycap 10*a* is assembled, a function test is necessary for preventing the keycap 10*a* and balance lever 12*a* from improper operation due to fault assembly. However, in the current structure, even the hooks 13*a* of the balance lever 12*a* is not substantially matched to the slots 15*a* of the key seat 14*a*, when the keycap 10 is pressed, the balance lever 12*a* remains to move into the keycap 10*a* so as to be tested successfully so that the key switch can be turned on or off. Therefore, it can pass the test. However, since the hooks 13*a* of the balance lever 12*a* are not substantially matched to the slots 15*a* of the key seat 14*a* so that the balance lever 12*a* will be ineffective. Therefore, the prior art structure can not prevent the ineffectiveness of the balance lever due to the fault in assembly.

Therefore, it is apparently that the structure of the balance lever of a key switch in the prior art must be improved.

SUMMARY OF THE INVENTION

Accordingly, the primary object of the present invention is to provide a keyswitch structure with a keycap having a balance lever. A balance lever is pivotally installed within a keycap of a key switch. The balance lever is formed with two hooks. The balance lever is slidably matched to slots in a key seat. At least one block element is installed within the keycap. As the balance lever is not installed in the slots, the block element will generate a force to support and stop the balance lever so that the keycap of the key seat can not be assembled in the key seat normally and thus, it is failed in testing. Therefore, bad products can be found in the testing process.

Another object of the present invention is to provide a keyswitch structure with a keycap having a balance lever, in which In the present invention, since a dull-proof structure is added to the balance lever of a key switch, it will prevent from unbalance due to the ineffectiveness of the balance lever as that in the prior art.

The various objects and advantages of the present invention will be more readily understood from the following detailed description when reading in conjunction with the appended drawing.

DETAILED DESCRIPTION OF THE PREFERRED EMBODIMENTS

Figure 1:
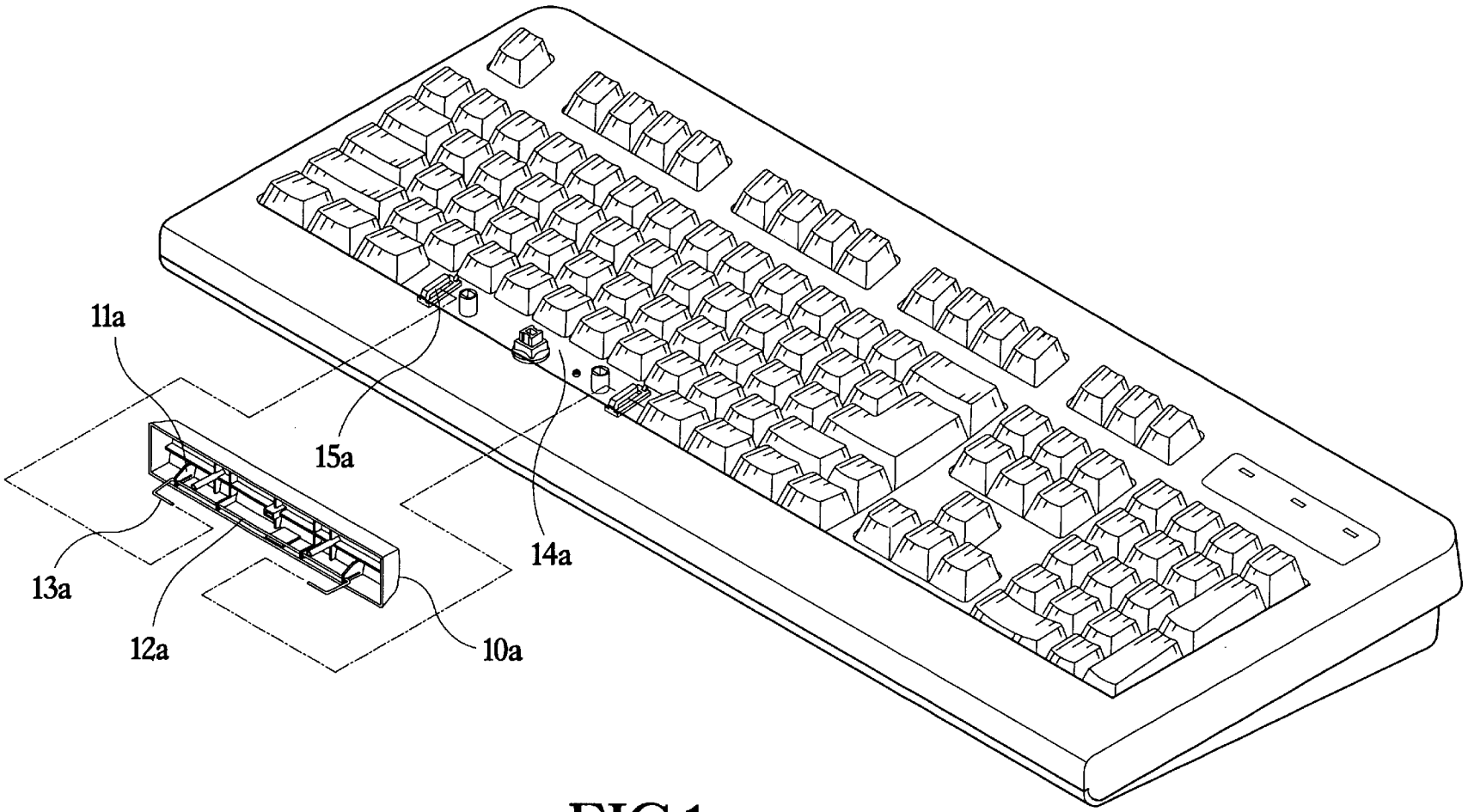
FIG.1 PRIOR ART
FIG. 1 is a perspective view of the switch and the balance lever in the prior art keyboard.
Figure 2:
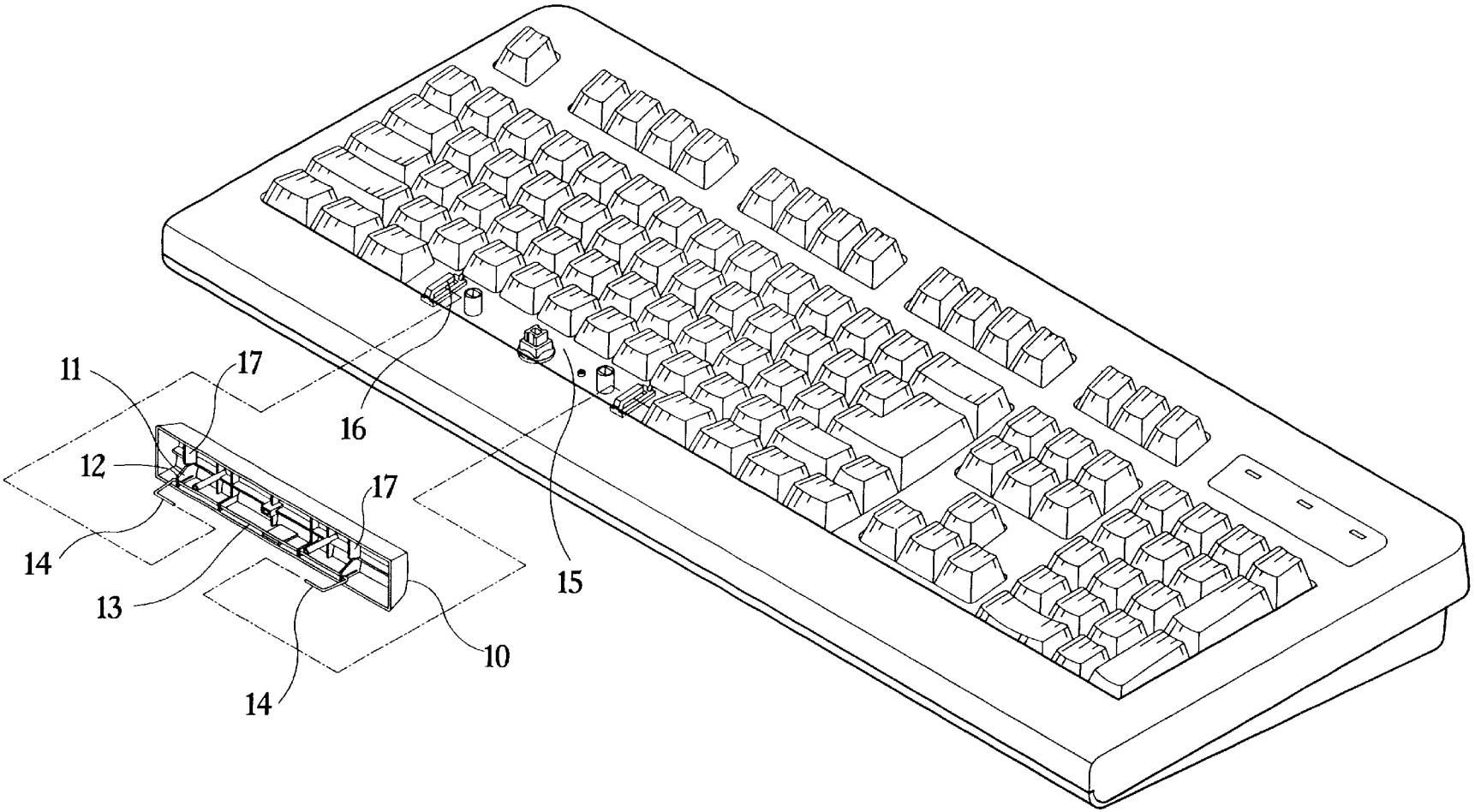
FIG. 2 is a perspective view of the present invention.
Figure 3:
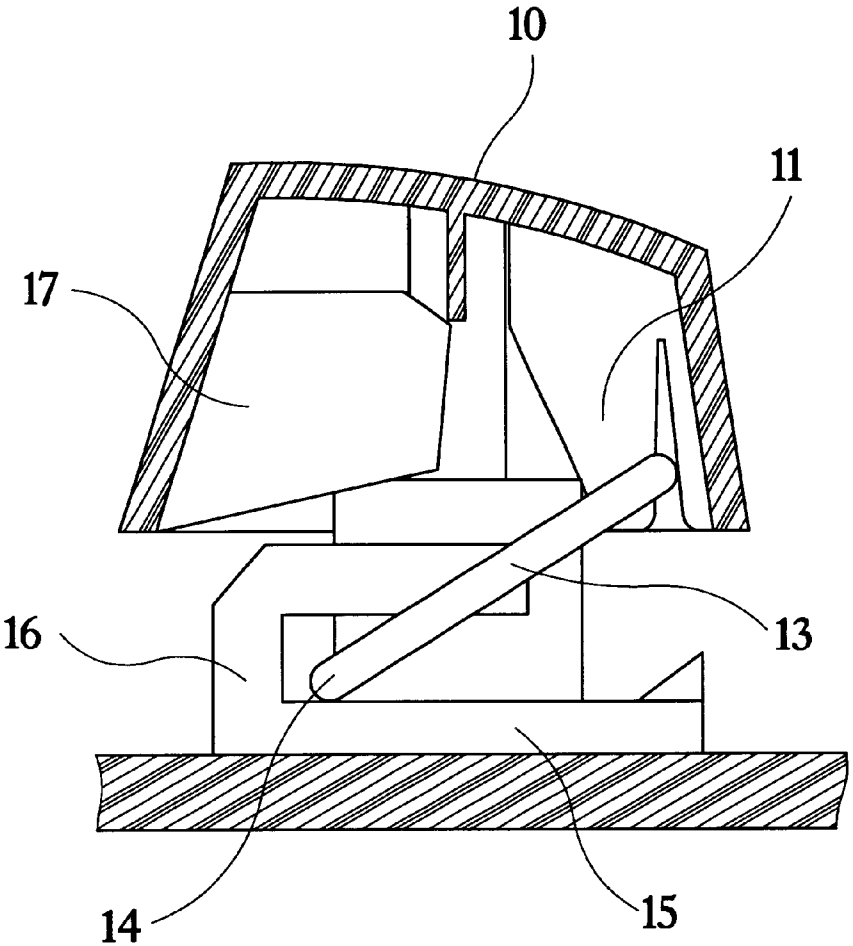
FIG. 3 is a plane view of the present invention.

With reference to FIGS. 2 and 3, one embodiment of the keyswitch structure with a keycap having a balance lever according to the preset invention is illustrated therein the key switch of a keyboard in the present invention has a keycap 10. A plurality of pivotal seats 11 are firmly secured within the keycap 10. Each pivotal seat 11 is installed with a pivotal hole 12 for being pivotally connected with an elastic metal balance lever 13 so that the balance lever 13 may be pivotally connected to the pivotal seats 11 within the keycap 10. The balance lever 13 has an approximate inverted U-shape. Two ends of the balance lever 13 each are formed with respective hooks 14. Two slots corresponding to the two hooks 14 are installed on the key seats 15. When the keycap 10 is assembled to the key seats 15, the two hooks 14 of the balance lever 13 are slidably matched to the two slots 16 of the key seats 15. When the keycap 10 is pressed or released so that the key switch is turned ON or OFF, the keycap 10 moves by the guiding of the hooks 14 in the slots 16. By the installing of the balance lever 13, the force from pressing the keycap 10 is transferred to the center of the keycap 10, and thus, the keycap 10 is acted steadily. The structure of the key switch is identical to that in the prior art and is not in the scope of the present invention, and thus, the detail thereof will not be described herein.

In the present invention, at least one block element 17 like a rib or other suitable shapes is formed in the keycap 10. In this embodiment, two block elements 17 with respect to the hooks 14 at two ends of the balance lever 13 are installed.

Figure 6:
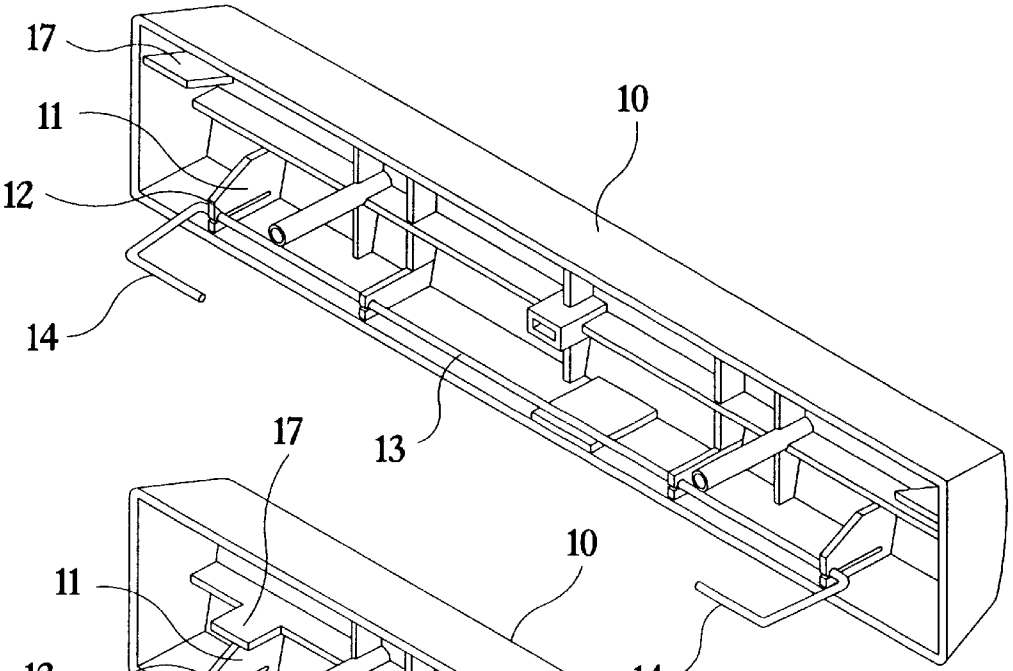
FIG. 6 is a perspective view of another embodiment in the present invention.
Figure 7:
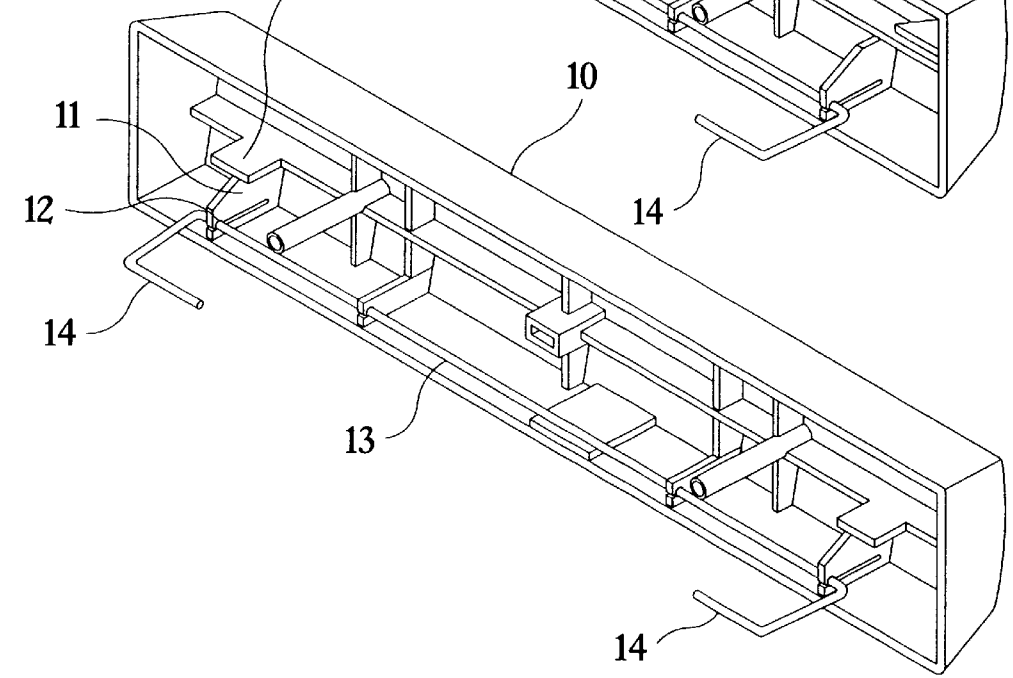
FIG. 7 is a perspective view of a further embodiment in the present invention.

The block elements 17 are integrally formed or adhered to the inner wall of the keycap 10 by other suitable ways. The block elements 17 are connected to the inner wall of front, rear, left, right (see FIG. 6) or top side (see FIG. 7) of the keycap 10 for supporting and stopping the balance lever 13. The position and shape of the block element 17 are not confined. Therefore, by aforesaid structure., a keyswitch structure with a keycap having a balance lever of the present invention is formed.

Figure 4:
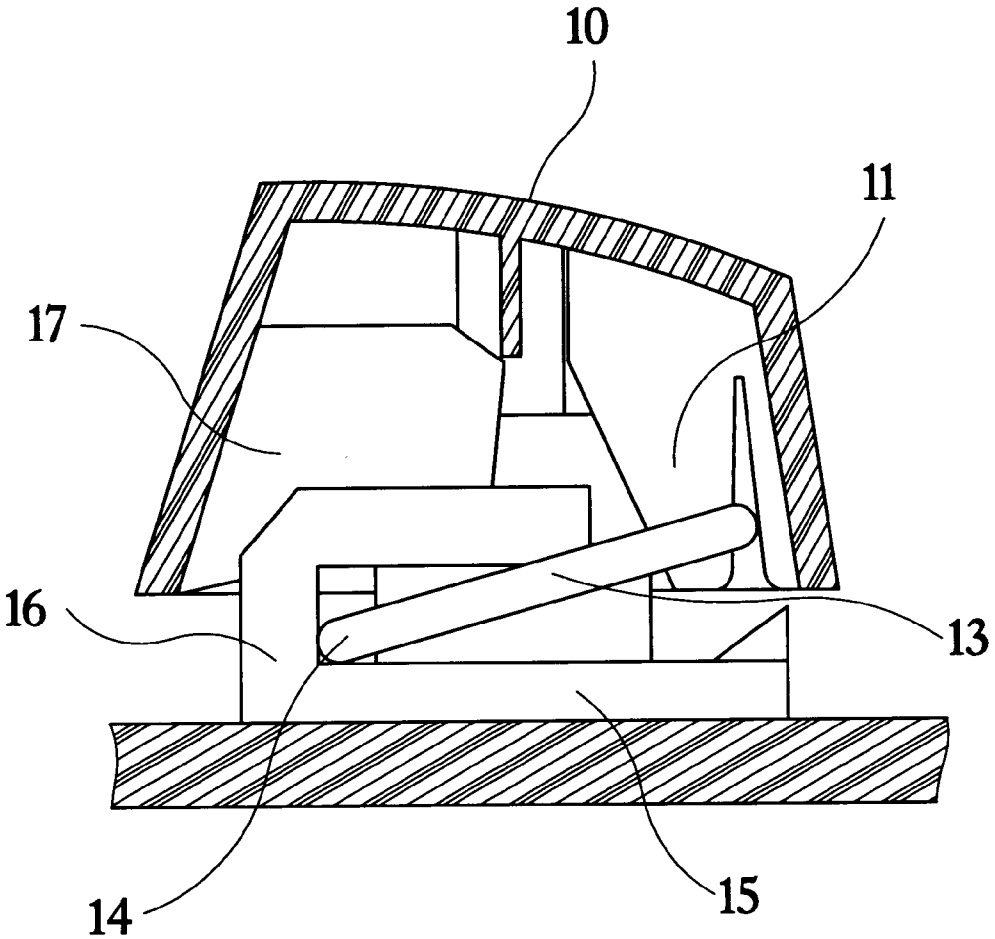
FIG. 4 is a schematic view showing the action of the present invention.

As shown in FIG. 4, when the hooks 14 of the balance lever 13 are substantially matched to the slots 16 of the key seats 15, if the keycap 10 is pressed, then the keycap 10 is operated normally so that the key switch is turned ON or OFF and is successful in testing.

Figure 5:
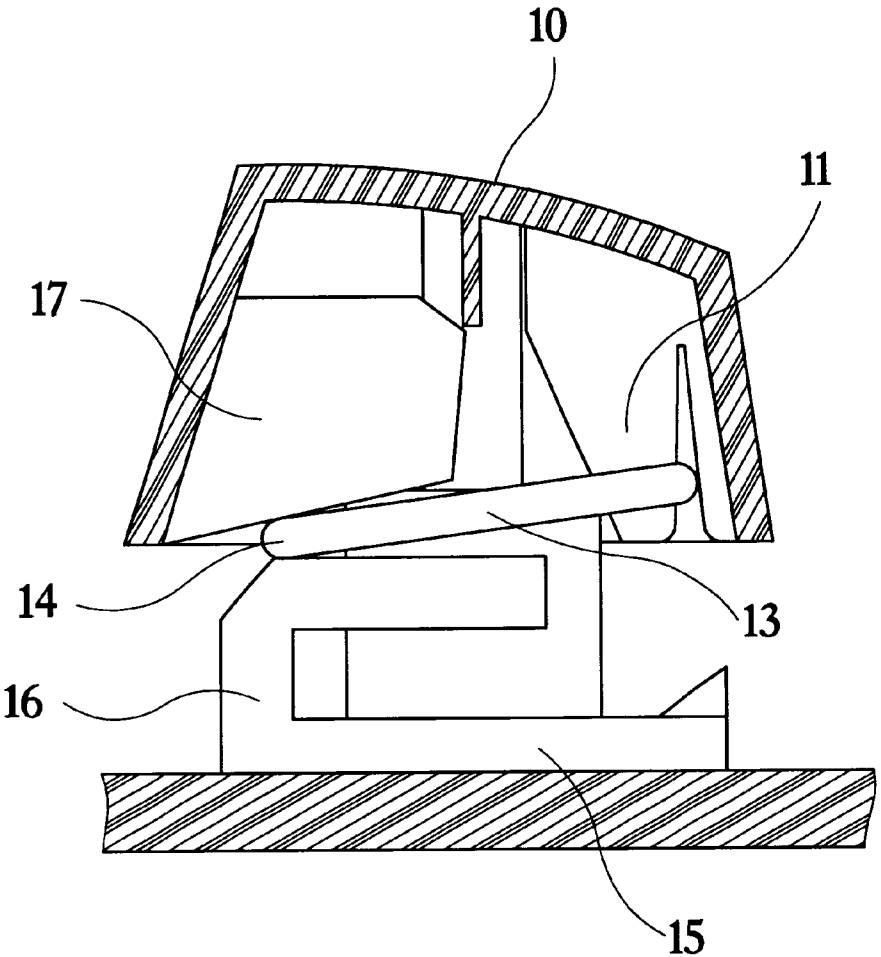
FIG. 5 is a schematic view showing that the present invention is improperly assembled.

Referring to FIG. 5, when the hooks 14 of the keycap 13 do not substantially match to the slots 16 of the key seats 15, if the keycap 10 is pressed, the hooks 14 of the balance lever 13 will be supported and stopped by the block element 17 so that the balance lever 13 cannot move into the keycap 10. On the contrary, as the keycap 10 is desired to move downwards, the balance lever 13 will impact the top of the slot 16 so as to be stopped so that the keycap 10 cannot be pressed normally and thus is not successful in testing.

In the present invention, block elements 17 are added in the keycap 10 for supporting the balance lever 13. If the balance lever 13 has not been installed in the slot 16, the block elements will support and stop the balance lever 13 so that the keycap of the key switch cannot be assembled in the key seat. Thus, it will not be successful in testing. In the present invention, since a dull-proof structure, such a the block elements of this invention, is added to the balance lever of a key switch, it will prevent unbalance due to the ineffectiveness of the balance lever as that in the prior art. Moreover, since the dull-proof structure of the present invention has a simple structure, the cost is not increased.

In summary, by the present invention, the defect in the prior art balance lever, such that the ineffectiveness of the balance lever, can be improved.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A keyswitch structure for a keyboard, comprising:

a switch element mounted to a keyboard;

a keycap coupled to said switch element and having at least one pivotal seat formed therein, said switch element being operated by depression of said keycap;

a balance lever pivotally supported by said pivotal seat;

at least one key seat mounted to the keyboard, said key seat having at least one slot formed therein for receiving a respective end portion of said balance lever therein; and, at least one block element coupled to said keycap, said block element being located at a position to contact a portion of said balance lever responsive to depression of said keycap when said end portion of said balance lever is displaced external to said slot and thereby limit said depression of said keycap and block operation of said switch element.

2. The keyswitch structure for a keyboard as recited in claim 1, wherein said block element is a rib extending from an internal surface of said keycap.

3. The keyswitch structure for a keyboard as recited in claim 1, wherein said block element extends from an internal surface of said keycap.

4. The keyswitch structure for a keyboard as recited in claim 1, wherein said pivotal seat has a pivot hole through which said balance lever extends.

5. The keyswitch structure for a keyboard as recited in claim 1, wherein said end portion of said balance lever defines a hook slidably disposed in said slot of said key seat.

* * * * *